US006624734B2

(12) United States Patent
Lanoue et al.

(10) Patent No.: US 6,624,734 B2
(45) Date of Patent: Sep. 23, 2003

(54) DC VOLTAGE/CURRENT HEATING/ GELLING/CURING OF RESIN ENCAPSULATED DISTRIBUTION TRANSFORMER COILS

(75) Inventors: Thomas J. Lanoue, Cary, NC (US); Charles H. Sarver, Rocky Gap, VA (US); Harold Younger, Halifax, VA (US); Rush B. Horton, Jr., Wytheville, VA (US); Michael D. White, Wytheville, VA (US); Paul Szász, Plankstadt (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 09/957,905

(22) Filed: Sep. 21, 2001

(65) Prior Publication Data

US 2003/0058076 A1 Mar. 27, 2003

(51) Int. Cl.[7] ..... H01F 27/02

(52) U.S. Cl. ..... 336/90; 336/205; 336/96; 29/602.1

(58) Field of Search ..... 336/96, 90, 205, 336/206; 29/602.1

(56) References Cited

U.S. PATENT DOCUMENTS

| | | | | | |
|---|---|---|---|---|---|
| 3,675,174 | A | | 7/1972 | Horbach | 335/299 |
| 3,904,785 | A | | 9/1975 | Baumann | 427/120 |
| 5,194,181 | A | | 3/1993 | Reitz | 252/500 |
| 5,357,015 | A | | 10/1994 | Haruvy et al. | 528/10 |
| 5,474,799 | A | | 12/1995 | Thigpen et al. | 427/104 |
| 5,589,129 | A | | 12/1996 | Kato et al. | 264/437 |
| 5,656,231 | A | | 8/1997 | Blackmore | 264/408 |
| 5,685,910 | A | | 11/1997 | Thigpen et al. | 118/666 |
| 5,710,535 | A | * | 1/1998 | Goloff | 336/192 |
| 5,861,791 | A | | 1/1999 | Schneider | 336/205 |
| 6,157,012 | A | * | 12/2000 | Tanaka et al. | 219/633 |
| 6,157,284 | A | | 12/2000 | Kanazawa | 336/198 |
| 6,160,464 | A | * | 12/2000 | Clarke et al. | 336/60 |
| 6,221,297 | B1 | | 4/2001 | Lanoue et al. | 264/219 |
| 6,223,421 | B1 | * | 5/2001 | Lanoue et al. | 29/605 |
| 6,248,279 | B1 | * | 6/2001 | Walsh | 264/254 |
| 6,359,062 | B1 | | 3/2002 | Mallen | 525/58 |
| 6,368,530 | B1 | * | 4/2002 | Adubato et al. | 264/154 |
| 6,445,269 | B1 | * | 9/2002 | Sylvain et al. | 336/84 R |

* cited by examiner

*Primary Examiner*—Anh Mai
(74) *Attorney, Agent, or Firm*—Woodcock Washburn LLP

(57) ABSTRACT

An internal heating method for drying, gelling and final curing of epoxy resin insulation systems used for encapsulating dry type cast distribution transformer coils is disclosed. The internal method uses a Direct-Current (DC) power source to control and supply DC current to resistively heat the transformer coil encapsulated with a liquid resin under vacuum in a mold. DC current is applied to a given coil based on its conductor cross-sectional area and its epoxy resin quantity to achieve a specified temperature for drying, gelling and final curing. The temperature, controlled by DC resistive heating is maintained for a given period for each step.

5 Claims, 6 Drawing Sheets

$T_{centre} > T_{end}$ $T_{int} \geq T_{cond} > T_{ext}$ $T_{bottom} > T_{top}$

DC VOLTAGE/CURRENT HEATING/ GELLING/CURING OF RESIN ENCAPSULATED DISTRIBUTION TRANSFORMER COILS

BACKGROUND OF THE INVENTION

1. Field of the Invention

The invention relates to an internal heating method for drying, gelling, and curing dry type distribution transformer coils that are encapsulated with resins and more particularly to a method of using DC voltage/current for the heating, gelling, and curing of vacuum cast, dry type distribution transformer coils encapsulated using mineral filled epoxy resin insulation systems.

2. Description of the Prior Art

The conventional process of heating, gelling, and curing of vacuum cast transformer windings has been through the application of external heat by way of forced-air convection ovens. In such prior art process the heat has been applied from outside in, which is opposite to the natural and most desirable process of gelling from the inside out. Inside out heating is not possible with conventional ovens. There are many drawbacks to outside in heating. First the temperature gradient is opposite to the moisture gradient causing very poor and slow propagation of the moisture out of the coil/insulation structure. Second the outside in heating causes the resin to gel on the outside, again opposite to the desired natural process of shrinking on the inside first. Both of these drawbacks and others cause the process cycle times to be in the order of two times a process, which could heat from inside out. This prior art process has been examined in an effort to reduce cycle time thereby increasing production capacity in order to decrease the process energy requirements. It would be desirable to use a variable Direct-Current (DC) power source to rapidly dry, gel and cure a transformer epoxy encapsulated coil through internal resistive heating. The process of the present invention minimizes internal stresses during gelling and curing in comparison to conventional oven and gelling curing techniques. This stress relief is primarily due to the heating of the coil from inside (conductor resistive heating) to outside compared to conventional oven heating which is from outside to inside. The process of the present invention reduces the long gelling and curing time by about 50–70% and the need for costly conventional ovens.

SUMMARY OF THE INVENTION

It is an object of the invention to provide an internal heating method for drying, gelling, and final curing of epoxy resin insulation systems used for encapsulating dry type vacuum cast distribution transformer coils. The present invention is directed to a method of insulating a transformer coil and includes the steps of placing a transformer coil into a mold to produce a coil/mold assembly, and applying a DC current to the coil to resistively heat the coil to a predetermined temperature and for a predetermined time to remove all moisture from the coil and the interior of the coil/mold assembly. The method further includes the step of applying a DC current to the coil/mold assembly while under vacuum to resistively heat the coil to hold a predetermined temperature and filling the mold with liquid epoxy resin to encapsulate the coil. The method further includes the step of applying a DC current to the coil to resistively heat the epoxy encapsulated coil to a predetermined temperature for a predetermined time to achieve epoxy gellation. The method further includes the step of continuing to apply a DC current to the coil to resistively heat the epoxy encapsulated coil to a final temperature and for a predetermined time to achieve a final cure for the epoxy encapsulated coil, and thereafter removing the cured epoxy encapsulated coil from the mold.

For a more detailed disclosure of the invention and for further objects and advantages thereof, reference is to be had to the following description taken in conjunction with the accompanying drawings.

DESCRIPTION OF THE PRIOR ART

Figure 2:
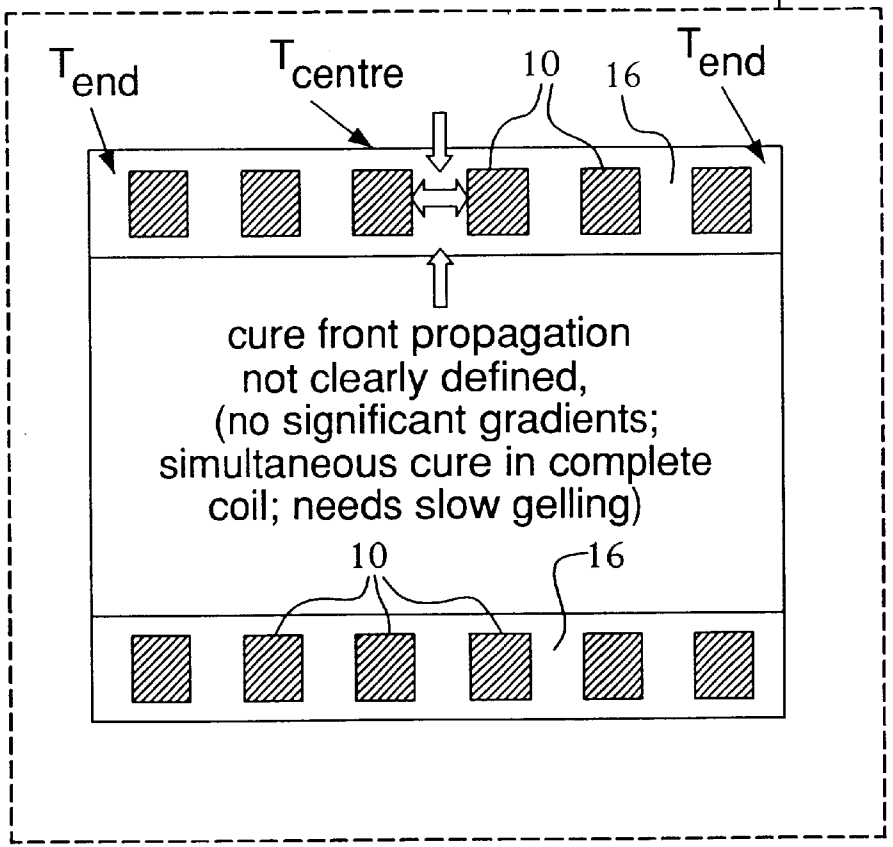
FIGS. 1 and 2 illustrate the conventional gelling/curing process of the prior art which is conducted in a standard convectional oven.
Figure 1:
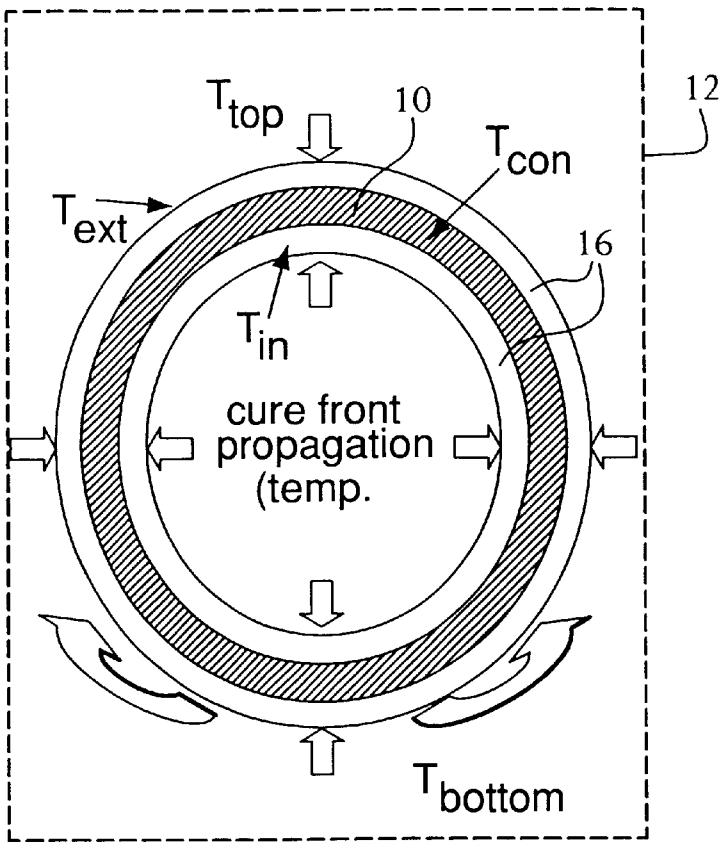

Referring to FIGS. 1 and 2 there is illustrated the conventional gelling/curing process for dry type epoxy resin encapsulated distribution transformer coils, which is conducted in a standard convectional oven. The process of the prior art involves placing a transformer coil 10 in a mold 12 to produce a coil/mold assembly 14, then moving the coil/mold assembly 14 with the molded part 10 and liquid resin 16 into a standard gel/cure oven, not shown. The oven temperature profile (80 to 140° C.) is controlled by a computer control device, not shown. The temperatures that are normally monitored are the temperatures at the top ($T_{top}$) and bottom ($T_{bottom}$), the exterior ($T_{exterior}$) and the temperature of the conductor ($T_{conductor}$) as shown in FIG. 1, and the temperatures at the ends ($T_{end}$) and the centre ($T_{centre}$) as shown in FIG. 2. In FIG. 1 $T_{bottom} \geqq T_{top}$ and in FIG. 2 $T_{centre} \geqq T_{end}$. The temperature of the molded part or coil 10 is held constant at about 100° C. for a period of approximately six hours at which time the gelling should be complete and then the temperature is gradually increased over a period of four hours until the temperature reaches 140° C. At 140° C. the curing cycle begins and normally extends over a period of six hours. In this conventional process, the heating is from the outside to the inside of the part as indicated by the large arrows, since the heat energy is coming from the oven. This is not a good gelling condition, since the outside gels first; thus closing or sealing the object with liquid resin within. The un-gelled resin is still expanding and evolving gases, which are now trapped; thus causing a potential internal void. To overcome or to minimize the risk of internal voids, the process times must be extended and conducted very slowly. Theoretically the resin should cure from inside to outside and bottom to top. In this way liquid resin is always available to fill voids due to chemical shrinkage and to fill voids due to gas evolution during the gelling phase.

DESCRIPTION OF THE PREFERRED EMBODIMENT

Figure 4:
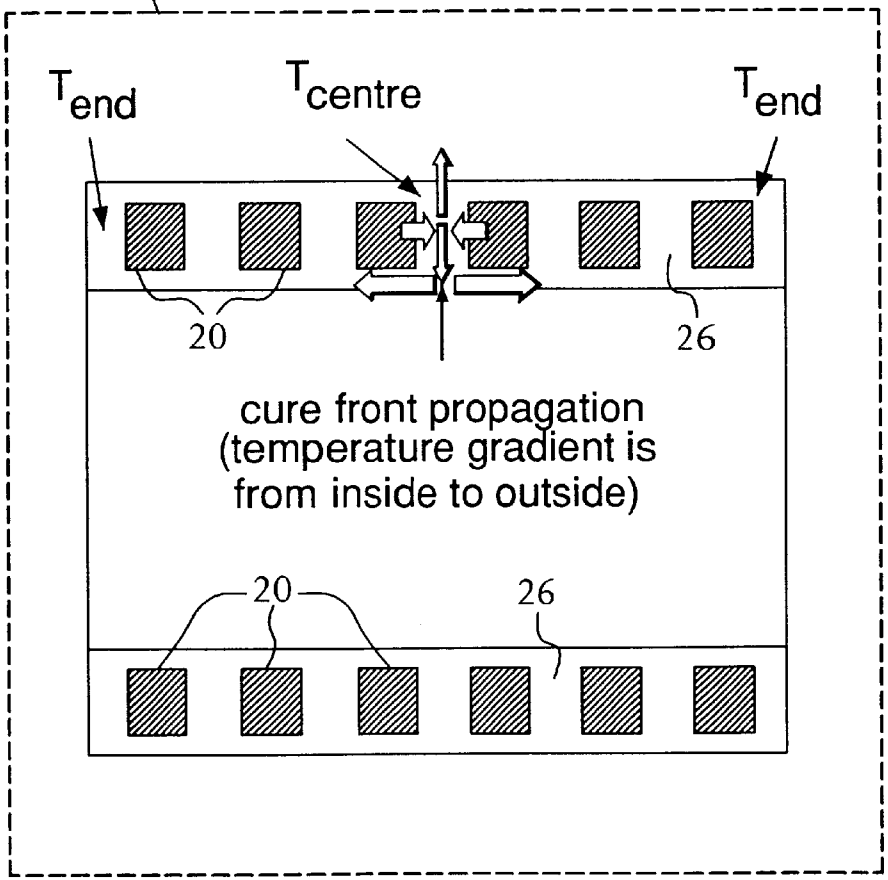
FIGS. 3 and 4 illustrate the present invention of heating the coil from inside to outside using DC heating.
Figure 3:
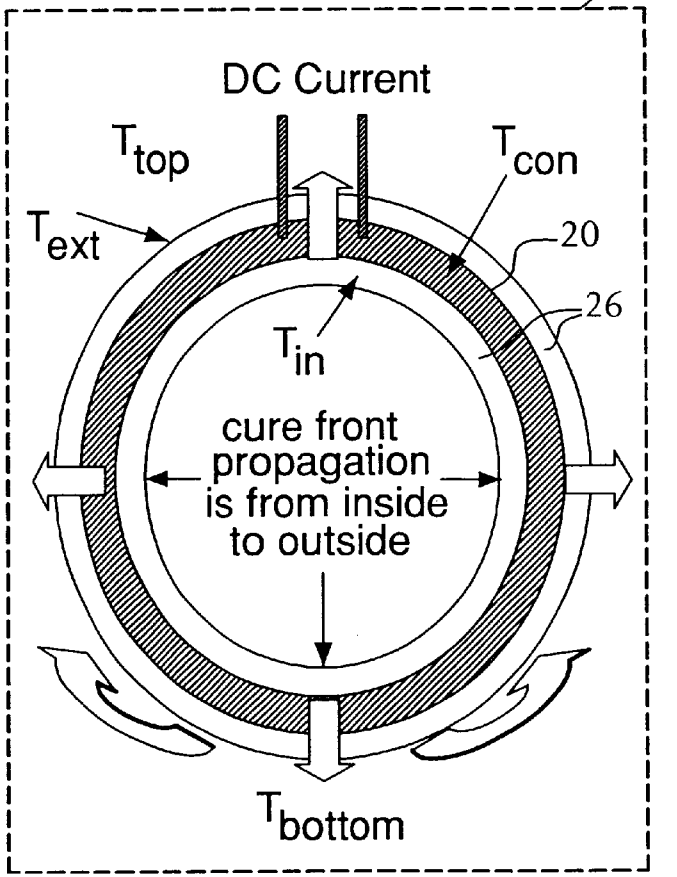
Figure 5:
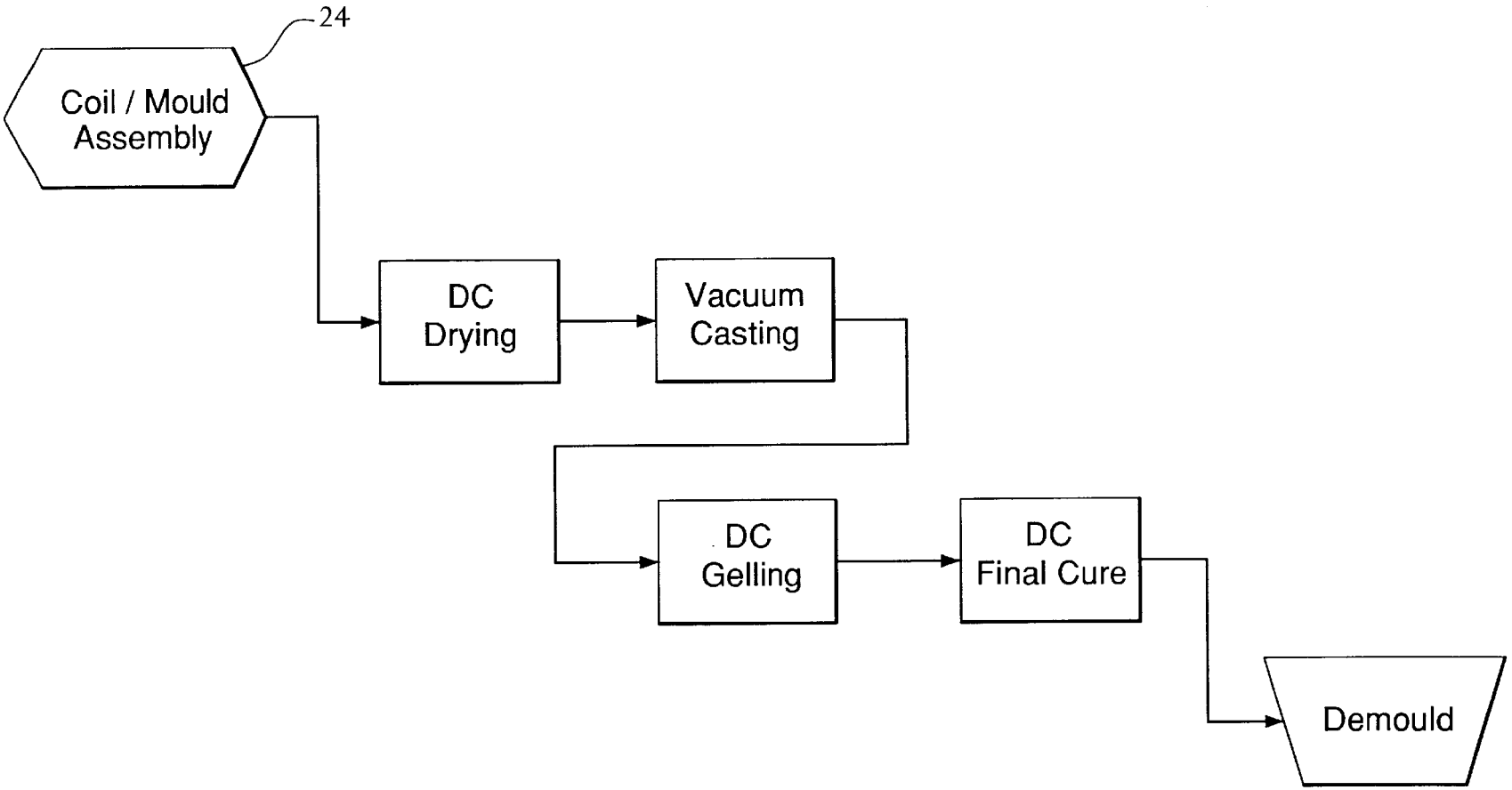
FIG. 5 is a diagrammatic drawing illustrated the various process steps of the present invention.

FIGS. 3, 4 and 5 illustrate the present invention process of heating a coil from inside to outside, as indicated by the large arrows in FIGS. 3 and 4, using DC heating. As seen in FIGS. 3 and 4 a transformer coil 20 is placed in a mold 22 to produce a coil/mold assembly 24. A DC current is applied to the coil 20 to resistively heat the coil to a predetermined temperature and for a predetermined time to remove all moisture from the coil and the interior of the coil/mold assembly 24. A DC current is applied to the coil/mold assembly 24 while under vacuum to resistively heat the coil 20 to hold a predetermined temperature and filling the mold 22 with liquid epoxy resin 26 to encapsulate the coil 20. A DC current is applied to the coil 20 to resistively heat the epoxy encapsulated coil to a predetermined temperature for a predetermined time to achieve epoxy gellation. The DC current flows through the conductors causing the conductor temperature to increase to a selected level; thus causing the gelling to occur from inside to outside. This eliminates the risk of internal voids. A DC current is continued to be applied to the coil 20 to resistively heat the epoxy encapsulated coil to a final temperature and for a predetermined time to achieve a final cure temperature for the epoxy encapsulated coil and thereafter removing the curing epoxy encapsulated coil from the mold. The process is completed at ambient temperature and pressure (room conditions) and no oven is required. In FIG. 3 $T_{bottom}>T_{top}$ and $T_{interior}\geqq T_{conductor}>T_{exterior}$. In FIG. 4 $T_{centre}>T_{end}$. By way of example $T_{conductor}$=110–120° C. as the approximate temperature range for gelling and up to about 140° C. for curing. The overall cycle time is reduced by 50% or more and there is a reduction in capital equipment investments.

The four basic steps that describe the casting production process of the present invention include drying, encapsulation, gelling and curing. See FIG. 5. The drying step requires heating to remove all moisture from the insulation system prior to the epoxy encapsulation step. This is performed after the coil is placed into the mold. In the encapsulation step the coil/mold assembly is placed under vacuum and filled with epoxy resin. In the next steps the resin filled coil/mold assembly must be gelled and cured at certain specified temperature vs. time profiles. The drying, gelling and curing steps require the application of energy to heat the coil/mold assembly to specified temperatures. The invention uses DC current to resistively heat the parts to the specified temperature vs. time profile. DC current is applied to a given coil based on its conductor cross-sectional area and its epoxy resin quantity to achieve a specified temperature for drying, gelling and final curing.

Figure 6:
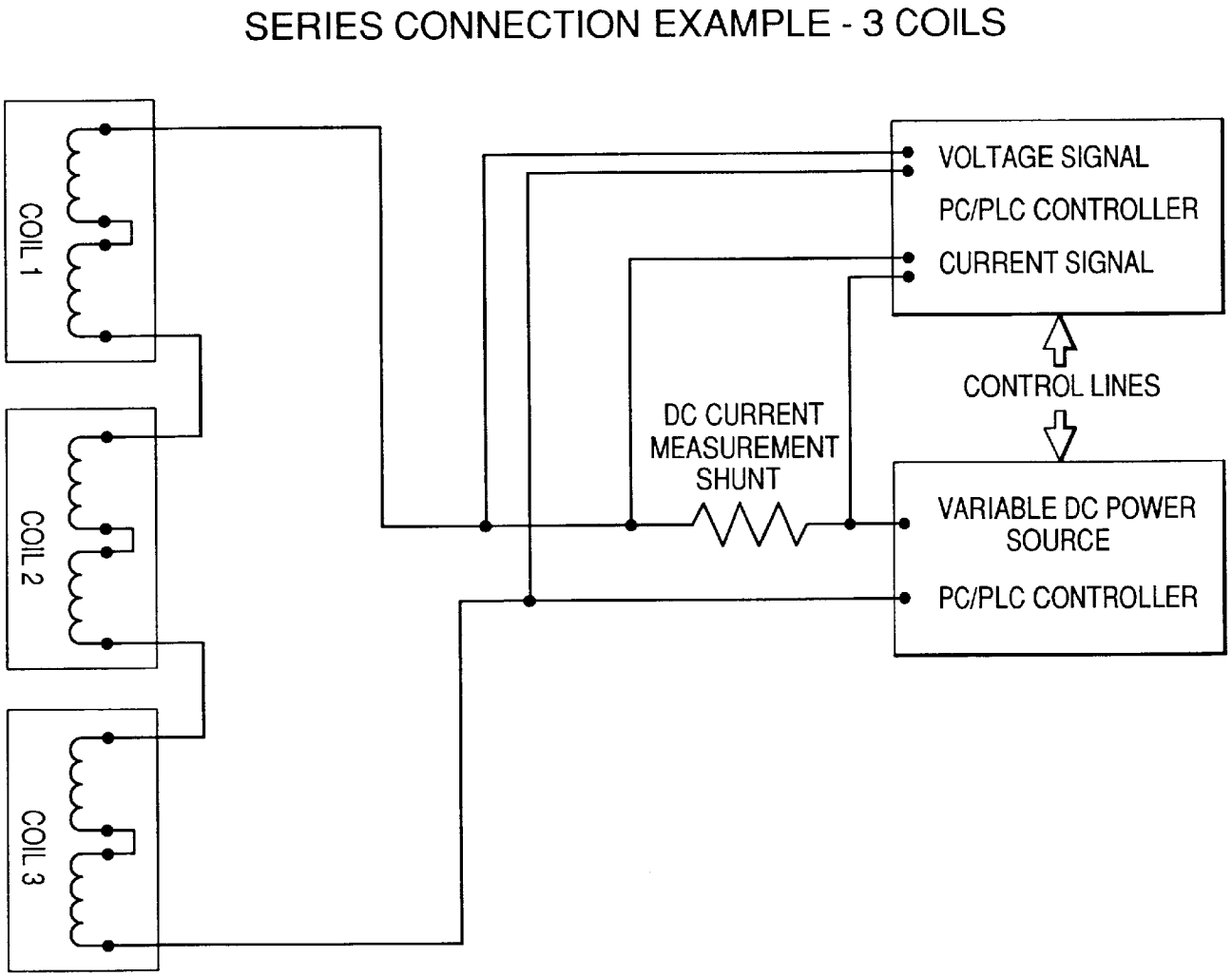
FIGS. 6 and 7 are simplified schematic drawings illustrating the typical series connection arrangement for using DC current to process multiple, identical windings simultaneously.
Figure 7:
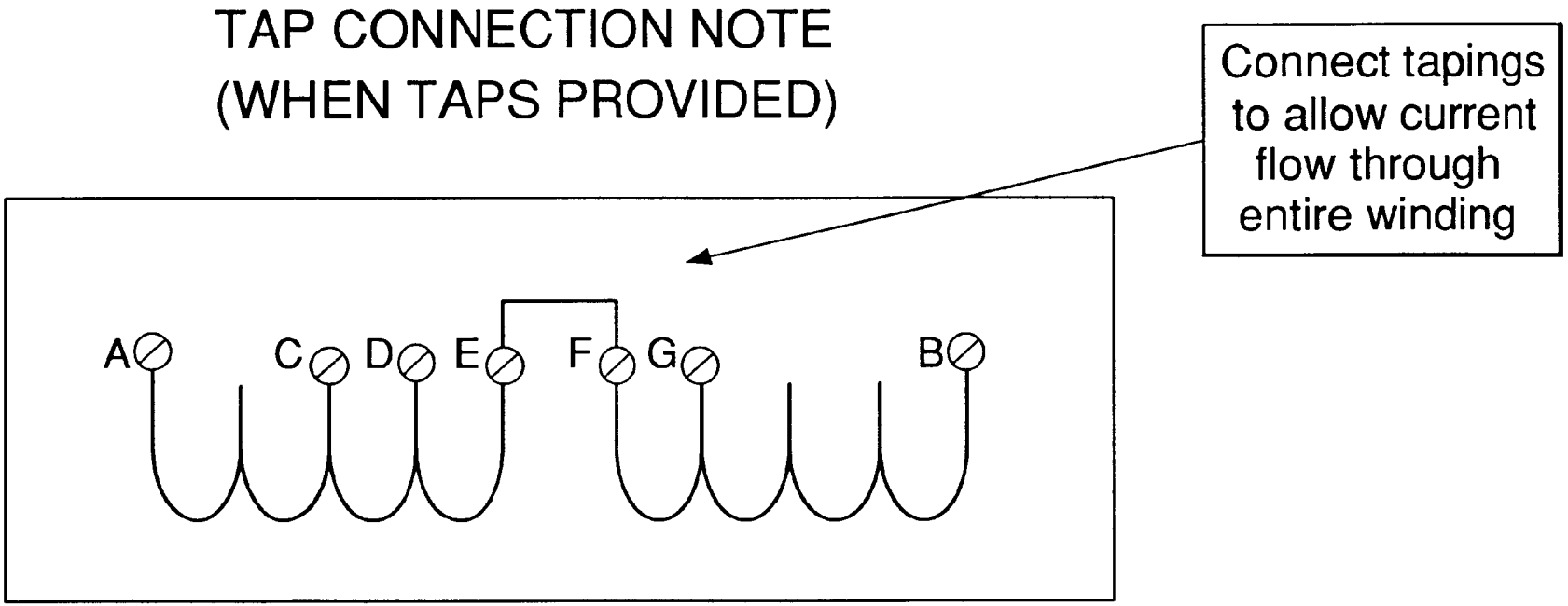
Figure 8:
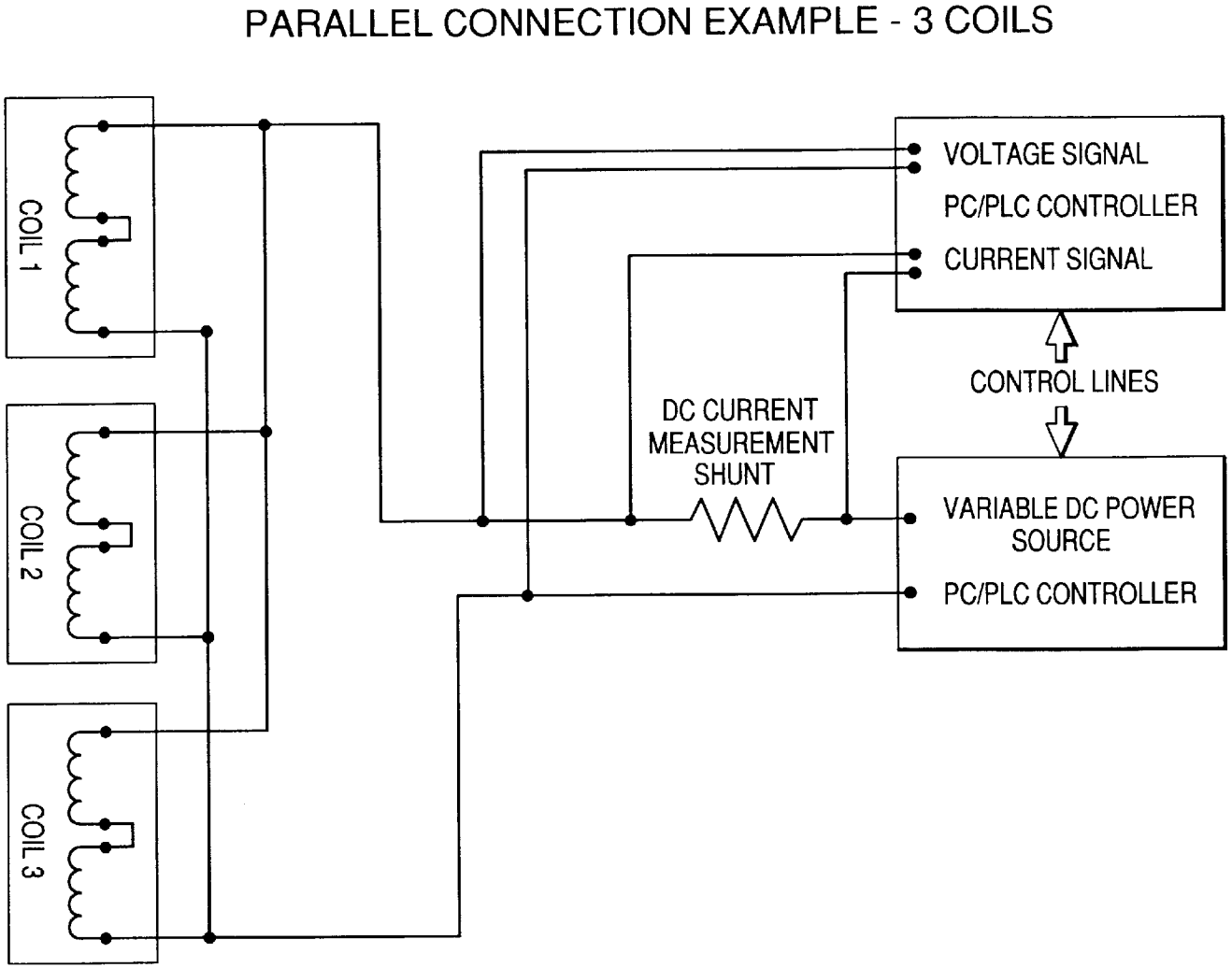
FIG. 8 is a simplified schematic drawing illustrating the typical parallel connection arrangement for using DC current to process multiple identical windings simultaneously.

Cross linking of the epoxy encapsulation is dependent of the temperature vs. time profile which must be accurately controlled throughout the entire process. This new process invention improves the accuracy of the temperature by DC conductor resistive measurement. Traditional temperature control methods use sensors, such as thermocouples, resistance temperature detectors, etc. which can compromise the dielectric integrity of a high-voltage insulation system. For these reasons, the gel/cure temperature must be controlled externally by the DC Power Source. This invention controls the temperature by the drop of potential (a conductor resistance method). Specifically, the resistance of the coil conductor is continually monitored by a personal computer/programmable logic computer (PC/PLC) controller and thus translated to temperature, as shown in FIGS. 6 and 8. DC voltage is applied and monitored along with circulating current to maintain the required conductor temperature for the various process steps. This method can be used for the complete process (i.e. pre-drying of the insulation material, gelling the epoxy, and final cure of the epoxy). By interconnecting identical windings in a series, FIG. 6, or parallel, FIG. 8, arrangement, multiple coils can be processed simultaneously. The examples shown in FIGS. 6 and 8 include three coils. As shown in FIG. 7 the tapings of each coil are connected so as to allow current flow through the entire winding.

While various types of molds may be used to practice the present invention, a disposable mold of the type disclosed in U.S. Pat. No. 6,221,297 is particularly suitable. The DC current required for complete processing in the present invention is dependent on the various characteristics of the windings being processed. The present invention has been used over a wide range of product, for example from 112.5 KVA through 12,000 KVA, which results in an extremely wide range of DC voltage and current required for heating to a specific temperature. In order to determine the requirements to DC process a specific winding or set of windings, it is necessary to obtain the following design data. Conductor type (aluminum or copper), conductor cross-sectional area, rated operating voltage, rated operating current, and temperature rise at rated current. From this data, and measurements of winding resistance at room temperature, one can calculate the resistance of the winding at the target process temperature. In addition, further data such as physical dimensions of the winding, epoxy volume, conductor and insulation mass will help to predict the time/temperature profile to ensure the best cured characteristics of the encapsulated winding. By way of example, windings of the type disclosed herein normally have relatively large epoxy encapsulation thickness in the order of 250 to 375 mils.

An analysis of experimental data has provided a range of resistance as follows: Cast Low Voltage coils –0.00008 to 0.05 ohms at 25° C. and Cast High Voltage coils –0.01 to 55.0 ohms at 25° C. A DC power supply capable of processing around 90% of the aforesaid examples would need an output ranging from 5 volts at 3,000 amps to 1,000 volts at 250 amps.

While a preferred embodiment of the present invention has been described and illustrated, it is to be understood that further modifications thereof can be made without departing from the spirit and scope of the amended claims.

What is claimed is:

1. A method of insulating a transformer coil comprising the steps of:

(a) placing a transformer coil into a mold to produce a coil/mold assembly, (b) applying a DC current to the coil to resistively heat the coil to a predetermined temperature and for a predetermined time to remove all moisture from the coil and the interior of the coil/mold assembly, (c) applying a DC current to the coil/mold assembly while under vacuum to resistively heat the coil to hold a predetermined temperature and filling the mold with liquid epoxy resin to encapsulate the coil, (d) applying a DC current to the coil to resistively heat the epoxy encapsulated coil to a predetermined temperature for a predetermined time to achieve epoxy gellation, (e) continuing to apply a DC current to the coil to resistively heat the epoxy encapsulated coil to a final temperature and for a predetermined time to achieve a final cure temperature for the epoxy encapsulated coil, and (f) thereafter removing the cured epoxy encapsulated coil from the mold.

2. A method of insulating a transformer coil according to claim 1 wherein a DC voltage is applied to the coil conductor and monitored along with circulating current to maintain the required conductor temperature for the process steps (b)–(e).

3. A method of insulating a transformer coil according to claim 2 wherein the resistance of the coil conductor is continually monitored and translated to temperature.

4. A method of insulating a transformer coil according to claim 2 wherein a plurality of coils are processed simultaneously by electrically interconnecting identical coil windings in a series arrangement.

5. A method of insulating a transformer coil according to claim 2 wherein a plurality of coils are processed simultaneously by electrically interconnecting identical coil windings in a parallel arrangement.

* * * * *

UNITED STATES PATENT AND TRADEMARK OFFICE

CERTIFICATE OF CORRECTION

PATENT NO. : 6,624,734 B2
DATED : September 23, 2003
INVENTOR(S) : Lanoue et al.

It is certified that error appears in the above-identified patent and that said Letters Patent is hereby corrected as shown below:

Column 2,
Lines 42 and 43, delete "≧" and insert therefor -- ≥ --.

Column 3,
Line 25, delete "≧" and insert therefor -- ≥ --.

Signed and Sealed this

Sixteenth Day of December, 2003

JAMES E. ROGAN
*Director of the United States Patent and Trademark Office*